US011319709B2

(12) United States Patent
Coyle

(10) Patent No.: US 11,319,709 B2
(45) Date of Patent: May 3, 2022

(54) SUPPORT ARRANGEMENT FOR COVERING ELEMENTS OF A BUILDING

(71) Applicant: Masonry Support Systems Limited, Derbyshire (GB)

(72) Inventor: Sean Coyle, Derbyshire (GB)

(73) Assignee: Masonry Support Systems Limited, Derbyshire (GB)

( * ) Notice: Subject to any disclaimer, the term of this patent is extended or adjusted under 35 U.S.C. 154(b) by 29 days.

(21) Appl. No.: 16/843,294

(22) Filed: Apr. 8, 2020

(65) Prior Publication Data

US 2020/0318354 A1 Oct. 8, 2020

(30) Foreign Application Priority Data

Apr. 8, 2019 (GB) ..... 1904977

(51) Int. Cl.
*E04D 13/158* (2006.01)
*E04D 1/30* (2006.01)
(Continued)

(52) U.S. Cl.
CPC ..... *E04D 13/158* (2013.01); *E04D 1/30* (2013.01); *E04D 3/24* (2013.01); *E04D 3/3606* (2013.01);
(Continued)

(58) Field of Classification Search
CPC ..... E04D 1/30; E04D 3/24; E04D 3/3606; E04D 13/158; E04D 2001/303; E04D 2001/3617
See application file for complete search history.

(56) References Cited

U.S. PATENT DOCUMENTS 3,456,406 A * 7/1969 Bransford, Jr. ..... E04D 13/158 52/94
4,195,455 A * 4/1980 Chalmers ..... E04B 9/26 52/506.1
(Continued)

FOREIGN PATENT DOCUMENTS

EP 3330449 6/2018
GB 2562867 11/2018
(Continued)

OTHER PUBLICATIONS

EP20020165 European Search Report dated Aug. 26, 2020 (2 pages).
EP20020165 European Written Opinion dated Aug. 26, 2020 (4 pages).

*Primary Examiner* — James M Ference
(74) *Attorney, Agent, or Firm* — SmithAmundsen LLC

(57) ABSTRACT

A support arrangement for supporting covering elements on a soffit and/or a fascia of a building. The support arrangement has a backing member that is operable to receive covering elements and is formed at least partially from non-metallic material. The support arrangement further has an attachment means for attaching the support arrangement to a building or building component such that it forms a part of the building. The support arrangement is non-flammable and can easily receive fixings to fix covering elements thereto. Covering elements can be fixed to the support arrangement and then the arrangement can be attached to a building or building component such that the covering elements form a part of the soffit or fascia of the building.

17 Claims, 7 Drawing Sheets

(51) Int. Cl.
*E04D 3/24* (2006.01)
*E04D 3/36* (2006.01)
*E04D 3/361* (2006.01)

(52) U.S. Cl.
CPC ..... *E04D 2001/303* (2013.01); *E04D 2003/3617* (2013.01)

(56) References Cited

U.S. PATENT DOCUMENTS 4,461,128 A * 7/1984 Knoebl ..... E04D 13/158 52/748.11
4,595,165 A * 6/1986 Klingensmith ..... H01Q 1/1221 248/230.5
5,243,793 A * 9/1993 MacLeod ..... E04D 13/152 454/260
5,579,617 A * 12/1996 Schiedegger ..... E04D 13/158 52/287.1
5,799,446 A * 9/1998 Tamlyn ..... E04D 13/158 52/302.1
5,937,592 A * 8/1999 Tamlyn ..... E04D 13/152 52/95
5,946,864 A * 9/1999 Simpson ..... E04D 13/1585 52/94
5,950,375 A * 9/1999 Zaccagni ..... E04D 13/158 52/94
6,138,418 A * 10/2000 Dyer ..... E04D 13/158 52/90.2
7,093,394 B1 * 8/2006 McNamara ..... E04D 13/15 248/48.2
7,104,013 B1 * 9/2006 Gates ..... E04D 13/158 52/60
7,487,623 B2 * 2/2009 Rodolofo ..... E04D 13/152 52/288.1
8,316,587 B2 * 11/2012 Shugart ..... E04D 13/158 52/96
8,978,321 B1 * 3/2015 Peck ..... E04C 2/38 52/94
9,187,912 B2 * 11/2015 Pulte ..... E06B 1/34
2002/0088584 A1 * 7/2002 Merkley ..... C04B 18/24 162/173
2002/0090871 A1 * 7/2002 Ritchie ..... E04C 2/043 442/42
2002/0170468 A1 * 11/2002 Luo ..... C04B 20/0048 106/731
2004/0092625 A1 * 5/2004 Pollock ..... C04B 28/16 524/42
2005/0126430 A1 * 6/2005 Lightner ..... C04B 18/241 106/15.05
2005/0257475 A1 * 11/2005 Gong ..... E04F 13/0862 52/506.05
2007/0137128 A1 * 6/2007 Viau ..... E04F 13/0803 52/388
2008/0148671 A1 * 6/2008 Monteer ..... E04F 19/06 52/533
2009/0007515 A1 * 1/2009 Mercer ..... E04F 13/0862 52/483.1
2009/0241444 A1 * 10/2009 Griffiths ..... E04F 13/0842 52/235
2010/0212234 A1 * 8/2010 Monteer ..... E04F 19/06 52/95
2010/0300329 A1 * 12/2010 Hamilton ..... C04B 28/02 106/665
2010/0300330 A1 * 12/2010 Hamilton ..... D21J 1/16 106/805
2012/0317899 A1 * 12/2012 Von Hoyningen Huene ..... E04B 2/7453 52/167.1
2013/0074424 A1 * 3/2013 Trascher ..... E04B 1/34384 52/79.5
2013/0269289 A1 * 10/2013 Gilbert ..... B26D 3/00 52/782.1
2018/0238059 A1 * 8/2018 Thomas ..... B28B 7/0073
2019/0100911 A1 * 4/2019 Collins ..... E04B 1/34321
2019/0186146 A1 * 6/2019 Savchyshyn ..... E04D 13/158
2020/0318354 A1 * 10/2020 Coyle ..... E04D 13/158
2021/0032873 A1 * 2/2021 Coyle ..... E04F 13/0833

FOREIGN PATENT DOCUMENTS

JP 2007-126886 5/2007
JP 2015-040427 3/2015
KR 20180061807 A * 6/2018
WO WO-0231287 A1 * 4/2002 ..... E04C 2/365
WO 2004044440 5/2004
WO WO-2017163193 A1 * 9/2017 ..... E04F 13/0894

* cited by examiner

SUPPORT ARRANGEMENT FOR COVERING ELEMENTS OF A BUILDING

CROSS-REFERENCE TO RELATED APPLICATIONS

This application claims priority to GB1904977.4, entitled "A Support Arrangement for Covering Elements of a Building," filed on Apr. 8, 2019, the disclosure of which is hereby incorporated by reference in its entirety.

BACKGROUND

The present invention relates to a support arrangement for supporting covering elements of a building.

In construction, there has been an increasing trend towards the use of masonry slips, such as brick slips, which are often bonded to steel backing boards, and then mounted on a face or soffit of a building. Such arrangements can be used, for example, in cladding panels or lintels to form parts of the fascia or soffit of a building. Masonry slip arrangements can be prefabricated before transporting to a site for installation and this reduces the amount of onsite time required to construct a building. Additionally, masonry slips arranged as ornate features, such as arched lintels, replaces onsite crafting of such ornate features, which can often be time consuming and require a high level of skill. Construction companies can produce entire building facades and sidings, composed of a plurality of masonry slip units, within a factory in a quality-controlled setting before transporting and assembling on site.

Concerns are being raised by certain sectors that the connection between the masonry slips and the steel backing board will weaken over time and the slips will come loose and fall from height. This is particularly concerning when the masonry slips form a part of a soffit and are therefore located vertically beneath the backing board, as gravity is constantly pulling the masonry slips away from the backing board. To mitigate this risk, there have been some recent improvements in how brick slips are bonded to backing boards. Typically, brick slips are bonded to steel backing boards using epoxy resins. Some backing boards also have cut-outs to receive the epoxy resin and, when the resin sets, this provides a lock between the brick slip and the backing board. A further solution is to mechanically fix each brick slip to the backing board. This typically requires drilling holes in the steel backing board so that bolts can then be fixed to the backing board via the holes to retain the slips on the board. This process is time consuming and, to save time, only minimal amounts of mechanical fixes are applied, and usually only in tandem with epoxy resins and not as a substitute.

Recent reviews of epoxy resins have suggested that some resins that are used for bonding brick slips to backing boards emit harmful toxins when burnt, and it is these toxins that can result in fatalities for occupants of a building containing such resins in the event of a fire. This is of particular concern in tall (over 18 metres) residential buildings and in the UK there are specific regulations to control the use of such resins in building components. It is expected that these regulations will be developed to further restrict usage of resins. There is therefore a need to reduce or replace the use of certain epoxy resins in these building components.

BRIEF SUMMARY

It is an object of the present invention to obviate or mitigate the problem of the use of adhesives to bond covering elements such as brick slips to supporting structures such as backing boards.

It is a further object of the invention to mitigate or obviate the problem of drilling steel backing boards to provide apertures for mechanically fixing masonry slips thereto.

According to a first aspect of the invention there is provided a support arrangement for supporting covering elements on a soffit and/or a fascia of a building, the support arrangement comprising a backing member that is operable to receive covering elements and is formed at least partially from non-metallic material, the support arrangement further comprising an attachment means for attaching the support arrangement to a building or building component such that it forms a part of the building.

Preferably, the backing member is formed at least partially from cementitious and/or composite material.

Advantageously, cementitious or composite backing members are more easily drilled than steel and can more readily and easily receive mechanical fixes such as screws. Therefore, covering elements, such as masonry slips, can more readily be mechanically fixed to a cementitious or composite backing member and this discourages the use of copious amounts of epoxy resin. The reliance on adhesives, such as certain epoxy resins, which can emit toxic fumes when burnt, is thereby mitigated by use of a cementitious or composite backing member to which covering elements can be easily mechanically fixed. Further advantageously, cementitious or composite materials used in construction are typically fireproof and are generally less expensive and are of lighter weight than steel or other purely metallic building materials.

Preferably, the support arrangement, most preferably the backing member, is non-combustible.

Ideally, the backing member is entirely formed from cementitious or composite material.

Preferably, the backing member is formed from a material being combination of cement and reinforcing fibres.

Ideally, the backing member is formed at least partially from mineral particle board such as magnesium oxide particle board, concrete, fiber-reinforced polymers, FRPs (including wood comprising cellulose fibers in a lignin and hemicellulose matrix), carbon-fiber reinforced plastic (CFRP) or glass-reinforced plastic (GRP), thermoplastic composite (short fiber thermoplastics, long fiber thermoplastics or long fiber-reinforced thermoplastics), thermoset composite, and/or aramid fibre and carbon fibre in an epoxy resin matrix.

Preferably, the backing member is formed at least partially from calcium-silicate based fibre cement. Advantageously, calcium silicate fibre cement is flexible, strong, water resistant and has high levels of dimensional stability.

Preferably, the support arrangement comprises a supporting structure.

Ideally, the backing member is supportable by the supporting structure.

Preferably, the backing member comprises one or more backing boards.

Preferably, the supporting structure is a supporting frame to which the backing member is fixable or fixed.

Ideally, the supporting structure comprises a plurality of spaced apart support members, the spacing between support members being traversable by the backing member.

Advantageously, using spaced apart support members instead of a continuous supporting structure can reduce the overall mass of the support arrangement.

Preferably, the backing member is fixed to the supporting structure by fixing means such as a screw and washer, pop rivet, spring clip, or any suitable fixing means.

Ideally, in use, the fixing means are located in spacings between covering elements and not between the covering element and backing member.

Advantageously, the fixing means does not interfere with the placement of covering elements on the backing member.

Ideally, the support members are sized and/or are spaced apart at predetermined distances according to the size of the covering elements to be fitted to the support arrangement such that the support members are fixed to the backing member by fixing means that are positioned between covering elements when the covering elements are applied to the backing member.

Advantageously, due to the size and/or predetermined spacings of the support members, fixing means for fixing the backing member to the support members can be located between covering elements in use and not between a covering element and the backing member. Each covering element thereby sits flush against the backing member and the attachment of the covering element to the backing member is not affected by the location of the fixings.

Preferably, the support members are directly or indirectly connected to one another thereby providing a supporting frame to which a backing member/board can be fixed.

Advantageously, the support member framework can be designed and manufactured in a factory, thereby minimising onsite construction times.

Ideally, the supporting frame, most preferably the support members, define a virtual plane to which a backing member/board can be mounted.

Ideally, one or more support members are elongate support members.

Preferably, the supporting structure is adapted to receive mechanical fixings such as screws or bolts.

Advantageously, this enables the backing member/board to be mechanically fixed to the supporting structure.

Ideally, the supporting structure comprises apertures sized to receive fixings such as screws or bolts.

Preferably, when mounted on a building or building component, at least a part of the support arrangement forms at least a part of a soffit of the building.

Advantageously, the support arrangement can be fixed to a building or building component at least partially via the attachment means.

Ideally, the attachment means is operable to mount or mechanically fix the support arrangement to a building component, or to hang the support arrangement from a building component.

Preferably, the attachment means is operable to mount or mechanically fix the support arrangement to a building component such that at least a majority of the support arrangement is suspended vertically below the building component.

Ideally, the attachment means is an elongate attachment means.

Ideally, the attachment means is operable to receive fixing means.

Preferably, the attachment means is operable to retain the support arrangement at or about a face of a building.

Preferably, the attachment means is operable to mount the support arrangement on a building such that at least part of the support arrangement forms at least a part of a building soffit.

Preferably, the support arrangement has a fascia-forming face.

Advantageously, the support arrangement may be used to form at least part of the fascia of a building.

Ideally, the support arrangement has a soffit-forming face.

Advantageously, the support arrangement may be used to form at least part of the soffit of a building.

Ideally, the fascia-forming face and/or the soffit-forming face are defined by the backing member.

Ideally, the fascia-forming face and the soffit-forming face are planar.

Preferably, the fascia-forming face and the soffit-forming face are arranged orthogonally to one another.

Preferably, one or more support members are fixed to the attachment means.

Ideally, one or more elongate support members are arranged extending away from the attachment means, most preferably, such that the longitudinal axis of the support member is perpendicular to the longitudinal axis of the attachment means.

Ideally and advantageously, the attachment means is further functional as a support member and can form a part of the supporting structure.

Preferably, the support members and the attachment means can be arranged defining a virtual plane to which a backing member/board can be mounted.

Advantageously, bespoke supporting structures can be produced by the manufacturer to accommodate a variety of shapes and sizes of backing members/boards.

Ideally, the attachment means is located to the rear of the fascia-forming face.

Preferably, the attachment means is located proximal an upper portion of the fascia-forming face. By "upper portion" we mean the uppermost portion of the fascia-forming face when the support arrangement is set upright as it would be orientated when installed on a building.

Ideally, the top of the attachment means is flush or near flush with the top of the fascia-forming face (when the support arrangement is orientated as it would be when fitted on a building).

Preferably, the attachment means is located at a position relative to the fascia-forming face such that when the support arrangement is fitted to a masonry support surface, the covering elements on the support arrangement form a continuous surface with masonry that is disposed and supported on the masonry support surface.

Ideally, the support members and/or the attachment means are formed at least partially from metal, most preferably at least partially from steel.

Ideally, one or more of the support members are formed from metal angles, most preferably, from folded metal angles.

Preferably, the support members extend along the rear of the fascia-forming face and/or the soffit forming face.

Preferably, the attachment means comprises an attachment channel that is operable to receive fixing means such as a nut and bolt.

Alternatively, the attachment means comprises fixing means operable to engage with a building component.

Alternatively, the attachment means comprises a means to hang the support arrangement from a building or building component.

Alternatively again, the attachment means comprises an interlocking arrangement to enable the attachment means to interlock with a corresponding arrangement on a building component.

Ideally, the attachment means comprises an elongate attachment channel.

Advantageously, the location of the support arrangement relative to the building component to which it is fixable can be adjusted along the longitudinal axis of the elongate attachment channel before torqueing the fixings.

Ideally, the attachment means comprises one or more fixing elements that are operable to fixedly engage with fixing means such as nuts or bolts.

Ideally, the fixing element(s) is/are movable relative to the attachment channel.

Advantageously, as the fixing elements are movable relative to the attachment channel, the position of support arrangement can be adjusted before fixing the support arrangement to a mount.

Ideally, the attachment channel and fixing elements are orientated such that the support arrangement can be fixed to a building component by vertically engaging the fixing elements with fixing means such as nuts or bolts.

In one embodiment, the fixing element is a male fixing element such as a bolt or screw that protrudes from the attachment channel to engage with a female fixing element such as a nut.

Alternatively, the fixing element is a female fixing element such as a nut that can receive a male fixing element that extends to the female fixing element of the attachment means.

Preferably, the female fixing element is a nut or machined block having an aperture to receive and fixedly engage with a fixing means such as a bolt.

Ideally, the fixing element is a spring nut.

Preferably, the attachment means comprises a retaining means to retain at least one fixing element within the attachment channel.

Ideally, the attachment channel is shaped to movably retain the fixing element(s) within the attachment channel.

Preferably, the retaining means comprises a retaining lip that extends over an opening in the attachment channel to movably retain the fixing element(s) therein.

Ideally, wherein the fixing element is a spring nut, the spring biases the nut against the retaining means.

Ideally, the covering elements that can be fitted to the backing member/board are masonry slips such as brick, block or stone slips, or glass-reinforced plastic slips.

Ideally, the covering elements are mechanically fixed and/or adhesively bonded to the backing member/board.

In one embodiment, the covering elements are fixed to the backing member/board solely by a mechanical fix and not via adhering, gluing or bonding the covering elements to the backing member/board.

Ideally, the support arrangement is prefabricated.

By prefabricated we mean it is manufactured, for example, in a factory, before being transported to a site for installation.

Preferably, the backing member is shaped to interlock with backing members of adjacent support arrangements such that a continuous surface is formed.

Ideally, the backing member is shaped to correspond to a brickwork pattern, such as stretcher, stack, header, English or Flemish brick bond, so that covering elements may be applied to the backing member to generate said brickwork pattern.

Ideally, a clipping means is provided to clip one or more end bricks to the support arrangement.

Preferably, a clipping means is provided to clip one or more end bricks to the backing member.

According to a second aspect of the invention there is provided a building assembly comprising a support arrangement for supporting covering elements on a soffit of a building, the support arrangement comprising a backing member that is operable to receive covering elements and is formed at least partially from non-metallic material, the support arrangement further comprising an attachment means for attaching the support arrangement to a building or building component such that it forms a part of the building, the building assembly further comprising a mount for the support arrangement, the mount being adapted to be installed as part of a building.

Ideally, the building assembly is a lintel or soffit building assembly.

Ideally, the building assembly is prefabricated.

Ideally, the mount is adapted to receive and retain the support arrangement thereto.

Ideally, the mount is adapted to engage with the support arrangement attachment means to mechanically fix, interlock or hang the support arrangement therefrom.

Preferably, the mount is adapted to form at least a part of a lintel or soffit supporting structure.

Ideally, the mount comprises a support surface for masonry.

Preferably, the support surface is an elongate support surface.

Ideally, at least a portion, most preferably each longitudinal end portion, of the support surface is shaped to fit between rows of masonry blocks/bricks.

Advantageously, the end portions can be embedded in a leaf of a wall, with the support surface extending over an aperture in the wall that is formed for a window or door. Masonry can then be placed on the support surface to continue the construction of the leaf over the aperture.

Preferably, the mount comprises fixings, and/or is adapted to receive fixings, the fixings being operably engageable with the attachment means to retain the support arrangement on the mount.

Preferably, the engagement between the mount and the attachment means is adjustable.

Advantageously, this provides further adjustability of the location of the cover element support arrangement on the building facing even after the mount has been mounted on a surface such as an inner leaf of a cavity wall.

Ideally, the mount comprises one or more male fixing elements operable to engage with a female fixing element on the support arrangement.

Alternatively, the mount comprises one or more female fixing elements operable to engage with a male fixing element on the support arrangement.

Alternatively again, the mount comprises an interlock arrangement to interlock with the attachment means.

Preferably, the mount comprises one or more apertures sized to receive a male fixing element such as a bolt.

Ideally, the one or more apertures are located at or about the masonry support surface.

Preferably, the one or more apertures are elongate.

Advantageously, the fixing elements can be moved within the aperture to adjust the position of the support arrangement before fixing the support arrangement to the mount.

Ideally, the mount is mountable on a surface such as an inner leaf of a cavity wall.

Preferably, the mount has mounting means, most preferably adjustable mounting means, for mounting the mount to a surface.

Advantageously, the adjustable mounting means allow the position of the mount relative to the surface to which it is fixed to be adjusted after installation. This allows fine adjustment of the position of the building component and this correspondingly allows fine adjustment of the location of the cover element support arrangement on the face/soffit of the building.

Preferably, the mounting means comprises one or more brackets operable to be mounted to a surface such as an inner leaf of a cavity wall.

Ideally, the masonry support surface is engaged with and is supported by the one or more brackets.

Ideally, the one or more brackets comprise a slot to receive a bracket fixing means.

Preferably, the mount comprises a lock washer that can be locked relative to the slot in more than one configuration.

Advantageously, changing the configuration of the lock washer relative to the slot can adjust the location of the bracket relative to the surface to which the bracket is fixed via a bracket fixing means that extends through the slot and into the surface.

Ideally the lock washer comprises a body; a protrusion disposed on one face of the body, the protrusion being configured to be disposable in a corresponding slot of a bracket; an engagement means disposed on the protrusion, the engagement means being configured to be engageable with the slot of the bracket and to hold the body stationary with respect to the bracket; and a slotted hole disposed in the body, the slotted hole being configured to admit a shaft of a bracket fixing means therethrough so as to allow lateral movement of the body relative to the shaft while the shaft is admitted through the slotted hole.

Ideally, the mount comprises a spacer insertable between the bracket and a mounting surface in use.

Preferably, the spacer is a shim.

Advantageously, this provides yet further adjustability by altering the position of the bracket, and therefore the masonry support surface, relative to the surface to which the mount is fixed.

According to a third aspect of the invention there is provided a method of constructing a support arrangement for cover-elements of a soffit of a building, the method comprising the steps of providing a cementitious/composite backing member and an attachment means and fixing the attachment means to the cementitious/composite backing member.

Ideally, the method comprising the step of forming a supporting structure and fixing the supporting structure to the cementitious/composite backing member.

Advantageously, the supporting structure and the attachment means can be formed as a single structure which can be fixed to the cementitious/composite backing member in a single step.

Ideally, the method comprising the step of connecting a plurality of supporting members to form a supporting frame to which a backing member can be fixed.

Preferably, the method comprising the step of mounting the backing member to supporting structure and/or attachment means via fixing means such as screws or bolts.

Ideally, the method comprising the step of bonding one or more covering elements to the backing member using adhesives.

Preferably, the method comprising the step of mechanically fixing one or more covering elements to the backing member.

BRIEF DESCRIPTION OF THE SEVERAL VIEWS OF THE DRAWINGS

The invention will now be described with reference to the accompanying drawings, which shows only three embodiments of a support arrangement according to the invention, and only one embodiment of a mount for a support arrangement according to the invention by way of example only.

DETAILED DESCRIPTION

Figure 14:
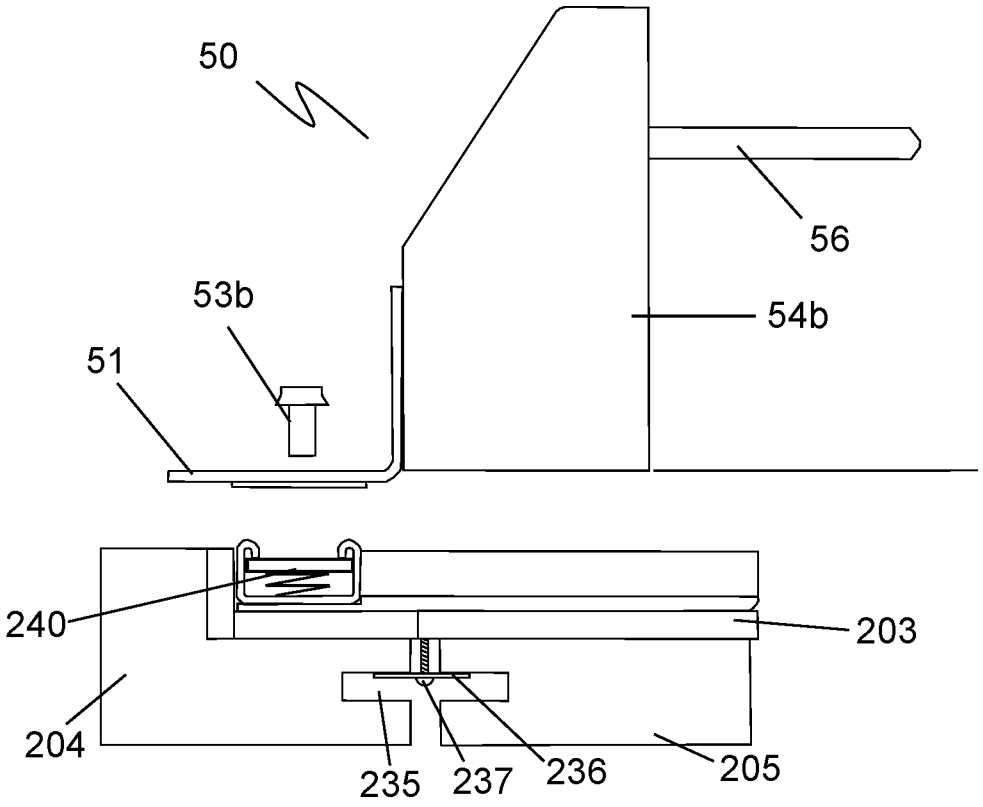
FIG. 14 shows a side view of the mount shown in FIG. 13, and a side view of a third embodiment of the support arrangement.

In FIGS. 1 to 4 there is shown a first embodiment of a support arrangement according to the invention illustrated generally by reference numeral 1. The support arrangement 1 has a supporting structure 2 and a backing member 3, the backing member 3 being a backing board 3. The backing board 3 is formed from two separate sheets of fibre cement board although other cementitious boards are suitable, and any number of sheets may be combined to form the backing member. For example, in one preferred embodiment, the backing board 3 is formed from calcium-silicate based fibre cement. The support arrangement 1 has a fascia-forming face 60 and a soffit-forming face 61, defined by the backing board 3. The fascia-forming face 60 and the soffit-forming to face 61 are planar with their planes extending orthogonally to one another. There are a series of twelve L-shaped brick slips 4 and twelve rectangular brick slips 5 arranged on the backing board 3 although alternative arrangements of brick slips will be apparent to the skilled person. Covering elements other than brick slips, such as composite slips, may also be used with the support arrangement 1. The brick slips 4, 5 are adhered to the backing board 3 by adhesives and/or mechanical fix however it is not necessary to adhere the brick slips 4, 5 to the backing board 3 as they can be fixed via a mechanical fix. There are numerous known ways to mechanically fix a brick slip to a surface. One example is shown in FIG. 14, where the brick slips 204, 205 have a slot 235 along their sides to receive a washer 236, the washer 236 then being fixed to the brick slips 204, 205 and the backing board. The L-shaped brick slips 4 are disposed on both the fascia-forming face 60 and the soffit-forming face 61. Specifically, the longer portion of the L-shape extends along the fascia-forming face 60, with the short portion on the soffit-forming face 61. The supporting structure 2 has a plurality of support members 6. In particular, it has four, spaced apart, elongate L-shaped support members 6. Each support member 6 has a flat portion 7 to which the backing board 3 is mounted. Each support member 6 further has a reinforcing flange 8 extending perpendicularly from the flat portion 7. The support members 6 have apertures 9 for receiving bolts (not shown) that extend into the backing board 3 thereby fixing the backing board 3 to the support members 6. In particular, the apertures 9 are located on the flat portions 7. The flat portions 7 are aligned such that they provide two virtual planes, one orthogonal to the other, to which the backing board 3 is mounted. The backing board 3 is mounted against the flat portion 7 of the support members 6 and traverses the spacings between the support members 6. The spacing between the support members 6 is such that an exact number of covering elements 3 can be mounted to the backing board in the space between the support members 6. This means that it is not required to place the covering elements over any of the fixings that fix the backing board 3 to the support members 6. The apertures 9 of the support members 6 are located between the covering elements 4 and the fixings that extend through the apertures 9 do not interfere with the placement of the covering elements 4 on the backing member 3. However, this is not essential in all embodiments as not all types of fixings will interfere with the covering elements, or the covering elements could be adapted to fit around the fixings.

The support arrangement 1 further has an attachment arrangement 10 to enable the support arrangement 1 to be attached to a building or building component, the support arrangement 10 in this embodiment being an attachment channel 10. The attachment channel 10 is located to the rear of the fascia-forming face 60 and it is proximal an upper portion of the fascia-forming face 60. The top of the attachment channel 10 is flush with the top of the fascia-forming face when the support arrangement 1 is orientated upright as it would be when fitted to a building component. The support members 6 are interconnected via an elongate attachment channel 10 that extends between the support members 6. The longitudinal axis of the attachment channel 10 is perpendicular the longitudinal axis of the support members 6. Specifically, the longitudinal axis of the attachment channel 10 is perpendicular to the longitudinal axis of part of the flat portion 7 that is fixed to the attachment channel 10. The flange 8 of each support member 6 is shaped to extend along a portion of the attachment channel 10. The attachment channel 10 is bifunctional in that it forms a part of the support framework to which the backing board 3 is fixed, and it is engageable with fixings of a mount for mounting the support arrangement 1 on a building. The attachment channel 10 has a base 15 with two mutually opposing sidewalls 16*a*, 16*b* that extend perpendicularly from the base 15, and an opening that is mutually opposing the base 15. The attachment arrangement 10 further has a retaining arrangement to retain fixing elements movably within in the attachment arrangement 10. In this embodiment, the retaining arrangement is formed by retaining lips 11, wherein the opening has two mutually opposed retaining lips 11 that extend from the upper portion of the sidewalls 16*a*, 16*b* to project over the opening.

Fixing elements such as a nut or bolt or similar element can be inserted into the attachment channel 10 to enable the support arrangement 1 to be fixed to a building or building component. For example, a spring nut can be inserted into the attachment channel 10 and slid along the attachment channel 10 to a desired location (see FIG. 14), thereby altering the final position of the support arrangement 1 relative to a mount. The spring biases the nut towards the opening and the retaining lips 11 retain the spring and the nut within the attachment channel 10 such that a bolt can easily engage with the nut. Alternatively, a machined block (not shown) having an aperture for receiving a bolt could be used within the attachment channel 10. The orientation of the attachment channel 10 and the fixing elements is such that fixing means can be inserted vertically downwards through a building component to engage with the fixing elements thereby fixing the support arrangement 1 to a building component. The attachment channel 10 is arranged extending along one edge portion of the backing board 3 such that fixings can attach to the edge of the backing board 3 when mounting the support arrangement 1. The support members 6 and the attachment channel 10 are formed from steel. The flat portion 7 of the support members 6 each extend from the base 15 of the attachment channel 10 and perpendicularly to the plane of the base 15. The reinforcing flange 8 extends across the base 15 and along the sidewall 16*a* and the attachment channel 10 is fixed thereto.

FIGS. 5 to 8 show a second embodiment of a support arrangement according to the invention referred to generally as reference numeral 101. The support arrangement 101 has a supporting structure 102 formed from three identical elongate support members 120 and two identical support members 121 having a shorter length than the three identical support members 120. Each of the support members 120, 121 have a flat portion 107 and a reinforcing flange 108 that extends from the flat portion 107 perpendicularly to the flat portion 107. The support members 120, 121 each extend form the attachment channel 110.

The support arrangement 101 has a backing board 103 formed from fibre cement boards. The backing board 103 is shaped to form a soffit surface having three rows 125*a*, 125*b*, 125*c* of brick slips wherein the middle row 125*b* is offset relative to the top 125*a* and bottom 125*c* row to replicate the appearance of a traditional brick wall. One row of the brick slips 125*a* forms a part of the face of the building when the support arrangement 101 is mounted, and each brick slip in this row has a right angle turn which extends out from the soffit surface and upwards along a portion of the face of the building. In this embodiment, the flat portion 107 of the support members 120, 121 extends perpendicular to the plane of the sidewall 116*a* of the attachment channel 110 and is coplanar with the plane of the base 115 of the attachment channel 110. The attachment channel 110 sits at the right angle of the brick slips 125*a* that form a part of the face of a building, and the support members 120, 121 extend back across the rows of brick slips 125*a*, 125*b*, 125*c*. The support arrangement 101 is shaped such that it can interlock with an adjacent support arrangement 101 of the same shape and interlock such that a continuous surface is formed. The rows 125*a*, 125*b* and 125*c* are all of equal length but the middle row 125*b* is offset relative to the upper and lower rows 125*a*, 125*c*, thereby creating a projection at one end that is engageable with an opening in a similar support arrangement, and an opening at the opposing end of the row 125*b* to receive a similar projection of an adjacent similar support arrangement. The shorter support members 121 extend across two rows 125*a*, 125*b*, terminating at the location of the third row 125*c*. The longer support members 120 extend between brick slips of the third row 125*c*.

The third embodiment of a support arrangement is shown in FIGS. 9 to 12 and is indicated generally by reference numeral 201. The arrangement 201 has a backing board 203 and a support frame 230 comprised of an attachment channel 210, an elongate support member 231 parallel to, and spaced apart from, the attachment channel 210, and three parallel and spaced apart support members 232*a*, 232*b*, 232*c* extending between the attachment channel 210 and the elongate support member 231. The longitudinal axes of each of the three shorter support members 232*a*, 232*b*, 232*c* extend perpendicular to the longitudinal axes of the attachment channel 210 and the elongate support member 231, defining a rectangular framework. The support arrangement 201 has two rows of brick slips 225*a*, 225*b* bonded to the backing board 203. A first row 225*a* of brick slips have a soffit surface and an outward-facing surface, the planes of the soffit surface and the outward-facing surface being orthogonal to one another. The second row 225*b* of brick slips form a part of the soffit. The second row 225*b* is laterally offset relative to the first row 225*a* to create a traditional brickwork effect. The support members 232*a*, 232*b*, 232*c* extend from the attachment channel 210 in a similar orientation to that of the second embodiment in that the flat portion 207 is coplanar with the base 215 of the attachment channel 210. The flat portion 207 extends underneath the base 215 and is between the base 215 and the backing board 203.

Figure 1:
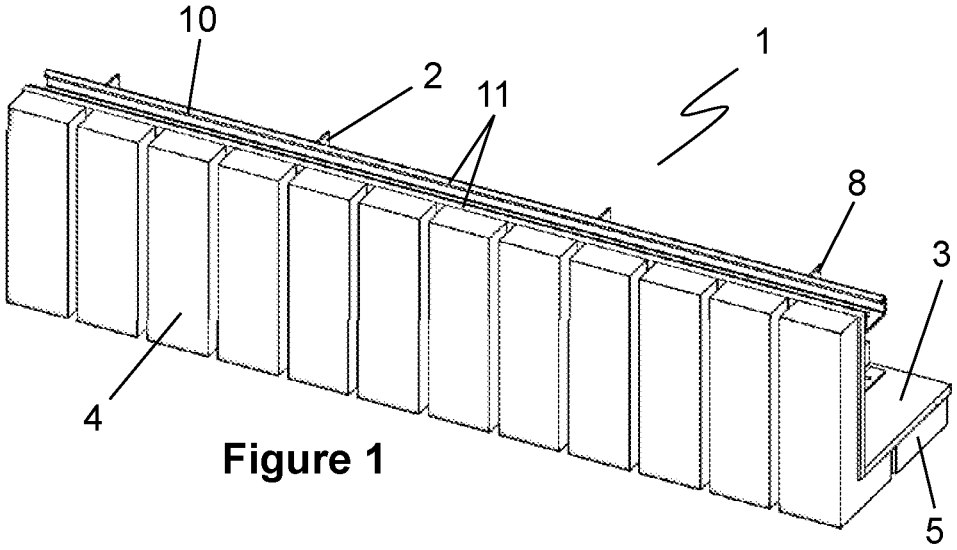
FIG. 1 shows a front perspective view of a support arrangement with cover elements attached thereto according to the invention.
Figure 2:
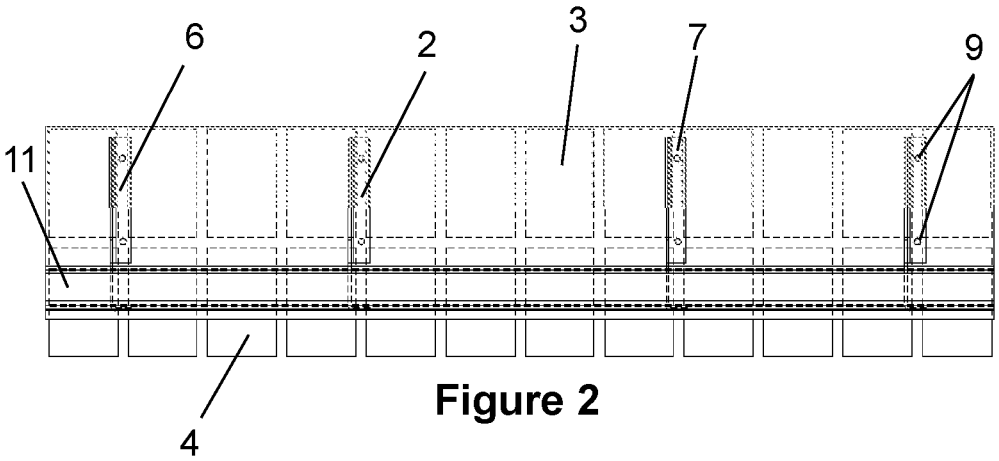
FIG. 2 shows a top plan view of the support arrangement of FIG. 1.
Figure 3:
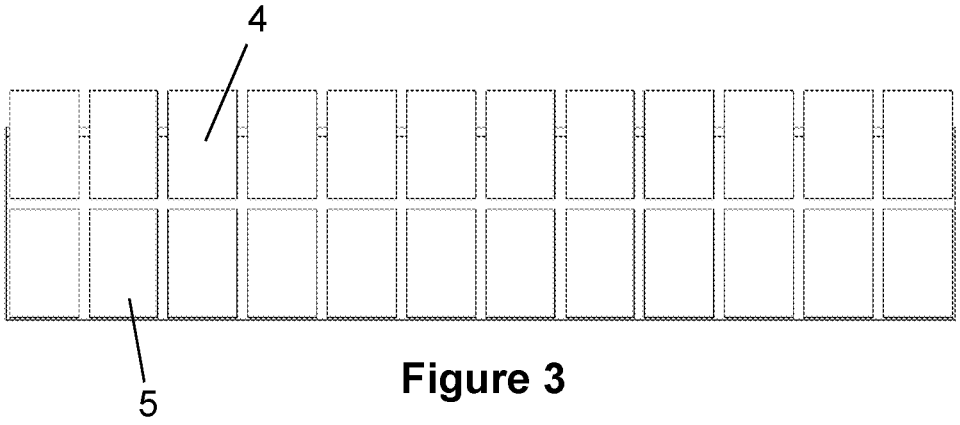
FIG. 3 shows an underside/soffit view of the support arrangement of FIG. 1.
Figure 4:
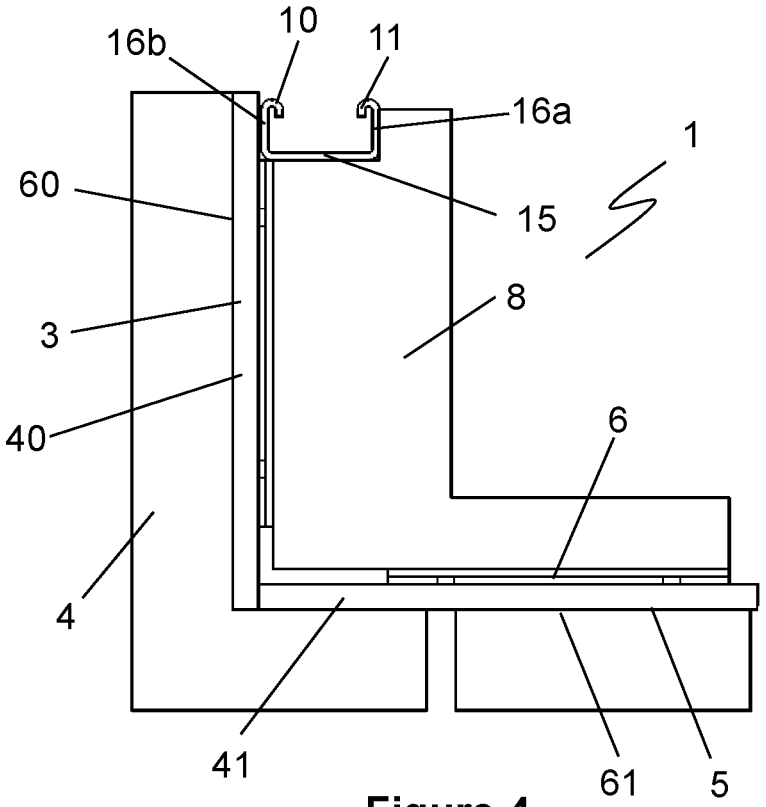
FIG. 4 is a side view of the support arrangement of FIG. 1.
Figure 5:
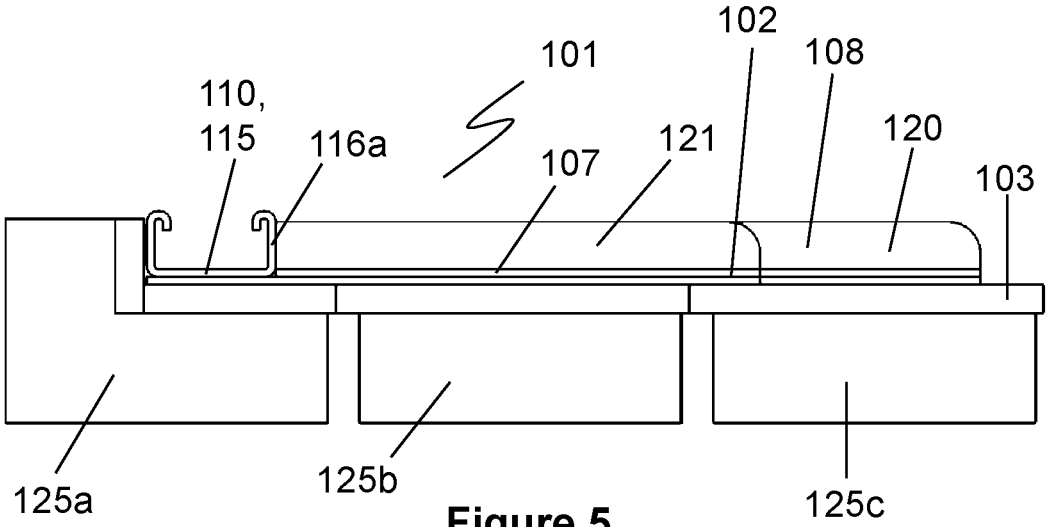
FIG. 5 is a side view of a second embodiment of a support arrangement with cover elements attached thereto according to the invention.
Figure 6:
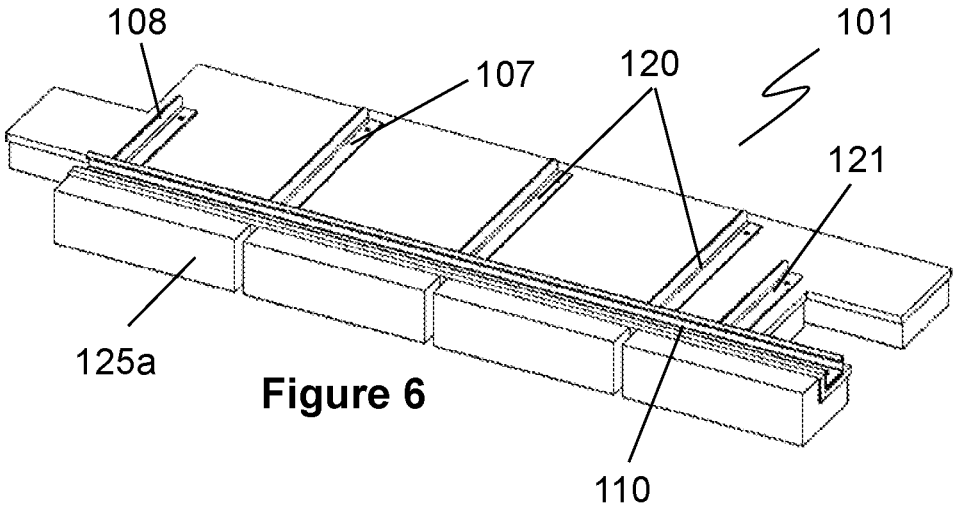
FIG. 6 is a front perspective view of the support arrangement of FIG. 5.
Figure 7:
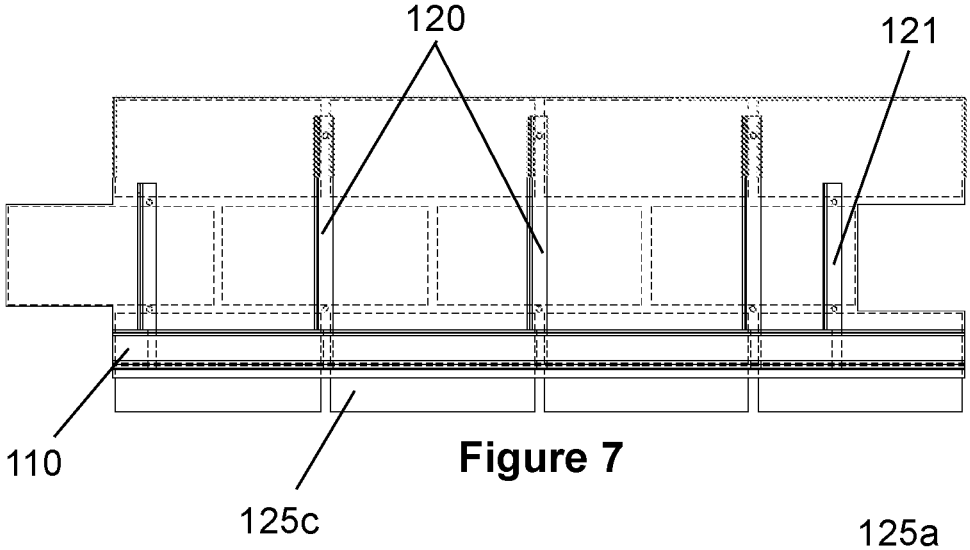
FIG. 7 shows a top plan view of the support arrangement of FIG. 5.
Figure 8:
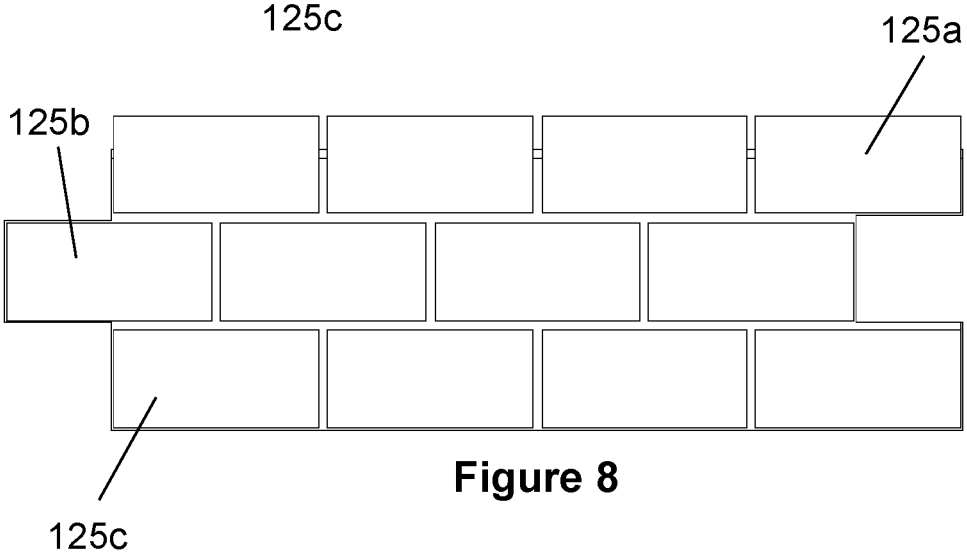
FIG. 8 shows an underside/soffit view of the support arrangement of FIG. 5.
Figure 9:
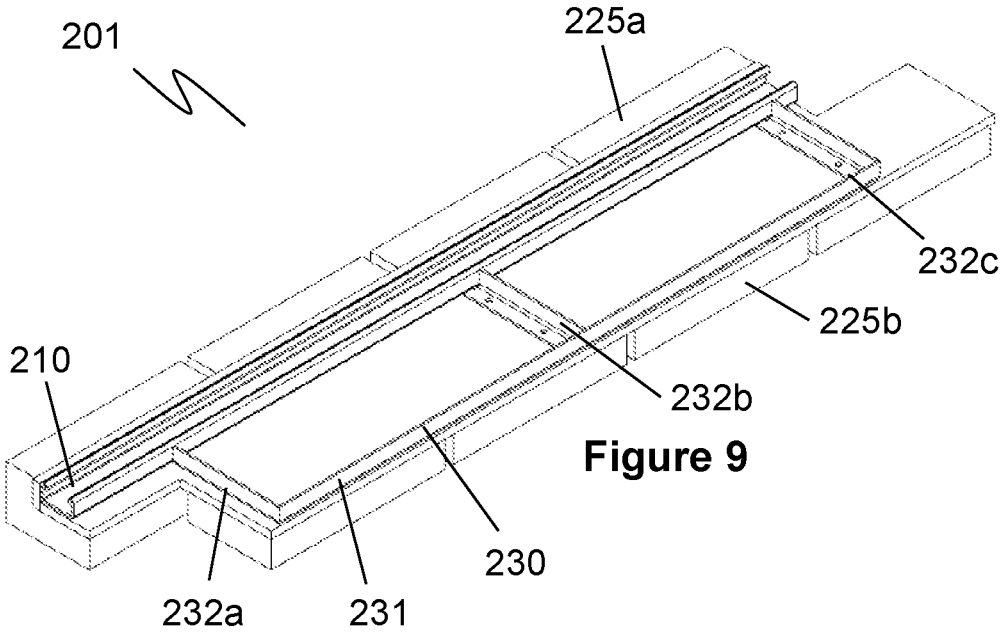
FIG. 9 shows a top perspective view of a third embodiment of a support arrangement according to the invention.
Figure 10:
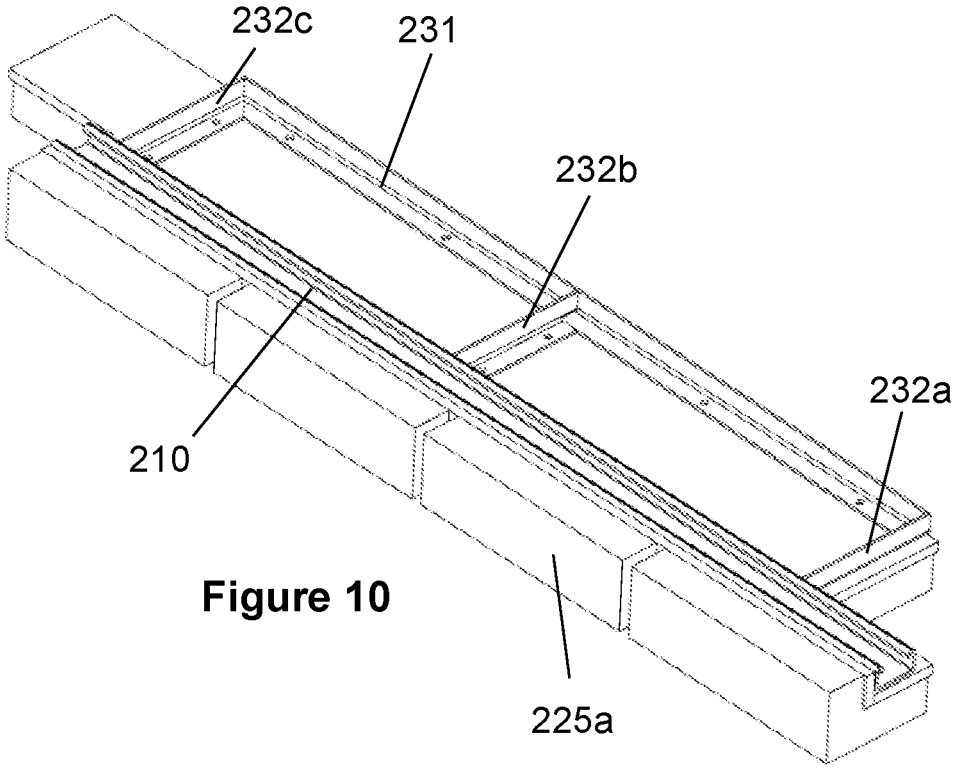
FIG. 10 shows a front perspective view of the support arrangement of FIG. 9.
Figure 11:
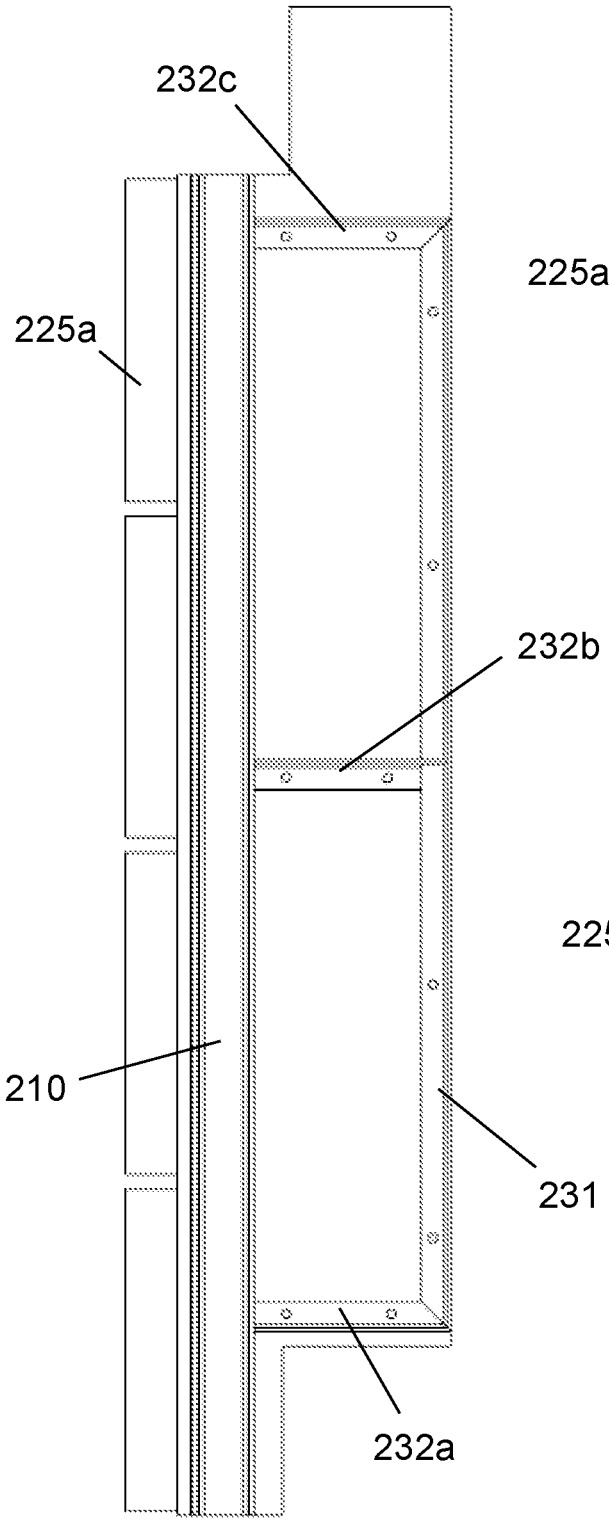
FIG. 11 shows a top view of the support arrangement of FIG. 9.
Figure 12:
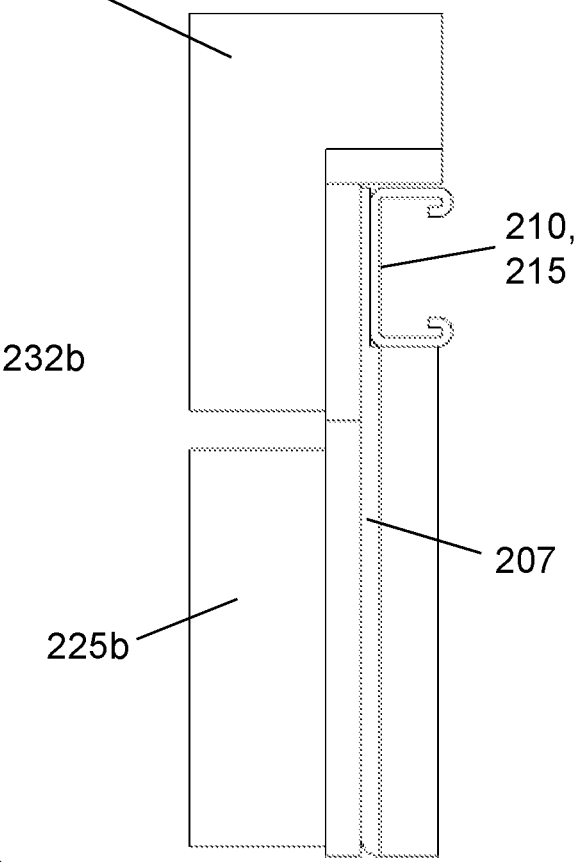
FIG. 12 shows a side view of the support arrangement of FIG. 9.
Figure 13:
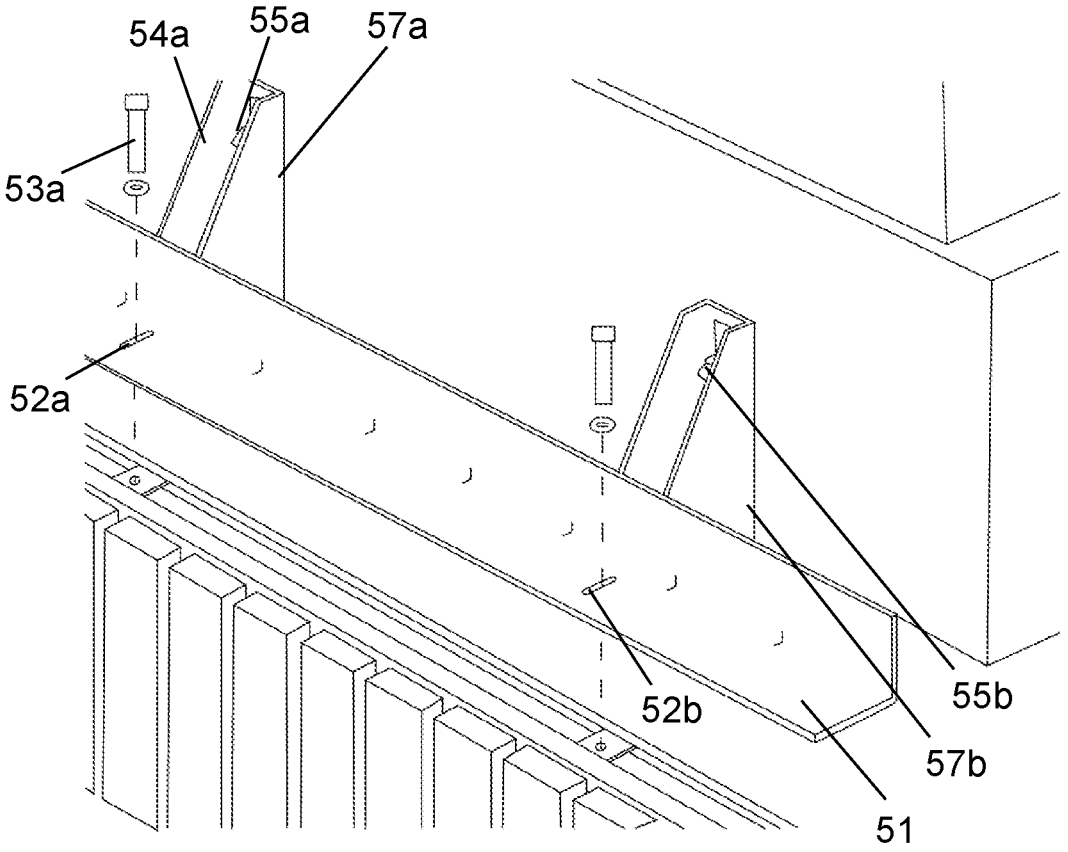
FIG. 13 is a front perspective view of a mount for a support arrangement as according to the invention.

Further provided by the invention and as shown in FIGS. 13 and 14 is a mount for a support arrangement 1, 101, 201 indicated generally by reference numeral 50. The mount 50 has a support surface 51 for masonry such as rows of brickwork. As shown in FIGS. 13 and 14, the mount 50 is adapted to form a part of a lintel. The support surface 51 functions as a shelf to which a support arrangement 1, 101, 201 can be attached, but it also provides a platform for the upper brickwork. The support surface 51 has a thickness not greater than that of the space between rows of brickwork, such that the end portions of the support surface 51 can be embedded between rows of bricks. The support surface 51 has two elongate slots 52*a*, 52*b* extending therethrough. The slots 52*a*, 52*b* are sized to receive bolts 53*a*, 53*b* that can engage with the support arrangement 1, 101, 201. In particular, the bolts 53*a*, 53*b* can engage with a spring nut 240 as shown in FIG. 14. The position of the support arrangement 1, 101, 201 can be moved forwards or backwards by adjusting the location of the bolt 53*a*, 53*b* in the slot 52*a*, 52*b* and the support arrangement 1, 101, 201 can be moved laterally by adjusting the location of the spring nut 240 in the attachment channel 10, 110, 210.

The mount 50 further has two spaced apart brackets 54*a*, 54*b* that each support the masonry support surface 51. The brackets 54*a*, 54*b* have a slot (not shown) and a lock washer 55*a*, 55*b* arranged to attach the brackets 54*a*, 54*b* to a wall with bolts 56. The bolts 56 extend through the slot and are fixed relative to the slot by the lock washers 55*a*, 55*b*. Each lock washer 55*a*, 55*b* has a body (not shown) and a protrusion (not shown) disposed on one face of the body. The protrusion is configured to be disposable in a corresponding slot of a bracket 54*a*, 54*b*. The lock washer further has an engagement arrangement (not shown) disposed on the protrusion that is configured to be engageable with the slot of the bracket 54*a*, 54*b* and hold the body stationary with respect to the bracket 54*a*, 54*b*. Further, there is a slotted hole (not shown) disposed in the body configured to admit a shaft of a bolt 56 therethrough to allow lateral movement of the body relative to the shaft while the shaft is admitted through the slotted hole. The mount 50 further has a shim 57*a*, 57*b* located and the wall, providing adjustability of the building arrangement.

In use, the support arrangement 1, 101, 201 can be prefabricated to a desired shape and size before fitting on a building. Initially, the supporting structure 2, 102, 202 is manufactured by assembling and welding together or otherwise connecting support members 6, 120, 121, 231, 232*a*, 232*b*, 232*c* to produce a desired framework. Ideally, although not essentially, an awareness of the final brick slip location should be considered when designing the support member framework. For example, in the first and second embodiments 1, 101, the fixings of the support members 6, 120, 121 are located between the brick slips. Either before or after assembling the supporting structure 2, 102, 202, holes should be drilled through the support members 6, 120, 121, 231, 232*a*, 232*b*, 232*c*. The attachment channel 10, 110, 210 should also be attached to the supporting structure 2, 102, 202 at this stage. The backing board 3, 103 is cut to size and then a mechanical fix (see FIG. 14) is installed between the backing board 3, 103, 203 and the supporting structure 2, 102, 202. This can be any suitable fixing such as a screw and washer, pop rivet, spring clip, or any suitable fixing means. Brick slips of desired size and shape are prepared and are bonded to the backing board 3, 103 using a grout/bonding method and/or mechanical fixings. Pointing can also be placed between the brick slips at this stage if desired.

The support arrangement 1, 101, 201 is mounted to a wall by first attaching a mount 50 to the surface of the wall. The brackets 54*a*, 54*b* of the mount 50 are first attached to the surface of the wall using a bolt 56 for each bracket 54*a*, 54*b*. A lock washer 55*a*, 55*b* is also used. The bolt 56 passes through the lock washer 55*a*, 55*b* and a slot of the bracket 54*a*, 54*b* and into the wall. The lock washer 55*a*, 55*b* can fixedly adjust the location of the bracket 54*a*, 54*b* relative to the placement of the bolt 56 after the bolt has been inserted into the wall. This enables the final location of the support arrangement 1, 101, 201 on the building to be adjusted even after the bolt has been inserted into the wall. Once the brackets 54*a*, 54*b* are fixed to the wall, the support arrangement 1, 101, 201 can then be fixed to the masonry support surface 50. The location of the attachment channel 10, 110, 210 relative to the fascia forming face 61 is such that when the support arrangement 1, 101, 201 is fitted to the masonry support surface 50, covering elements on the support arrangement 1, 101, 201 form a continuous, preferably patterned surface, with the brickwork that is disposed on and supported by the masonry support surface 50. Initially, spring nuts 240 are inserted into the attachment channel 10, 110, 210 and moved along the attachment channel 10, 110, 210 to the location of the slots 52*a*, 52*b* in the masonry support surface 50. Then bolts 53*a*, 53*b* are inserted through the slots 52*a*, 52*b* and the support arrangement 1, 101, 201 is raised, with the attachment channel 10, 110, 210 being located at the bolts 53*a*, 53*b*. The bolts 53*a*, 53*b* are tightened through the spring nuts 240 to fix the support arrangement 1, 101, 201 to the mount 50.

In the preceding discussion of the invention, unless stated to the contrary, the disclosure of alternative values for the upper or lower limit of the permitted range of a parameter, coupled with an indication that one of the values is more highly preferred than the other, is to be construed as an implied statement that each intermediate value of the parameter, lying between the more preferred and the less preferred of the alternatives, is itself preferred to the less preferred value and also to each value lying between the less preferred value and the intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof.

The invention claimed is:

1. A support arrangement for supporting covering elements on a soffit and/or a fascia of a building, the support arrangement comprising a non-combustible backing member that is operable to receive covering elements and is formed at least partially from cementitious and non-metallic material, the support arrangement further comprising an attachment means for attaching the support arrangement to a building or building component such that the support arrangement forms a part of the building;

wherein the attachment means comprises an elongate attachment channel, one or more fixing elements that are operable to fixedly engage with fixing means; and wherein the one or more fixing elements are movable relative to the attachment channel.

2. The support arrangement as claimed in claim 1 wherein the support arrangement has a soffit-forming face.

3. The support arrangement as claimed in claim 2 wherein the support arrangement has a fascia-forming face.

4. The support arrangement as claimed in claim 3 wherein the attachment means is located to a rear of the fascia-forming face and proximal an upper portion of the fascia-forming face.

5. The support arrangement as claimed in claim 1 wherein the attachment means is operable to mount or mechanically fix the support arrangement to a building component, or to hang the support arrangement from a building component.

6. The support arrangement as claimed in claim 5 wherein the attachment means is operable to mount the support arrangement on a building such that at least part of the support arrangement forms at least a part of a building soffit.

7. The support arrangement as claimed in claim 1, wherein the fixing element is a female fixing element that can receive a male fixing element that extends to the female fixing element of the attachment means.

8. The support arrangement as claimed in claim 1 wherein the attachment means comprises a retaining means to retain at least one fixing element within the attachment channel.

9. The support arrangement as claimed in claim 1 wherein the support arrangement comprises a supporting structure and wherein the backing member is supportable by the supporting structure.

10. The support arrangement as claimed in claim 9 wherein the backing member is fixed to the supporting structure by a fixing means.

11. The support arrangement as claimed in claim 9 wherein the supporting structure comprises a plurality of spaced apart support members having a spacing therebetween, the spacing between support members being traversable by the backing member.

12. The support arrangement as claimed in claim 11 wherein one or more of the plurality of spaced apart support members are fixed to the attachment means and wherein the support members and the attachment means are arranged defining a virtual plane, and the backing member is mounted to the plurality of spaced apart support members.

13. The support arrangement as claimed in claim 11 wherein the attachment means has a longitudinal axis and wherein one or more of the plurality of spaced apart support members are elongate support members having a longitudinal axis, and wherein one or more elongate support members are arranged extending away from the attachment means such that the longitudinal axis of the support member is perpendicular to the longitudinal axis of the attachment means.

14. The support arrangement as claimed in claim 11 wherein one or more of the plurality of spaced apart support members are formed from metal angles.

15. The support arrangement as claimed in claim 11 wherein the support members are sized and/or are spaced apart at predetermined distances according to a size of the covering elements to be fitted to the support arrangement such that the support members are fixed to the backing member by fixing means that are positioned between covering elements when the covering elements are applied to the backing member.

16. The support arrangement as claimed in claim 1 wherein the backing member is shaped to interlock with backing members of adjacent support arrangements such that a continuous surface is formed.

17. The support arrangement as claimed in claim 1 wherein the support arrangement comprises covering elements fitted to the backing member, wherein the covering elements are fixed to the backing member solely by a mechanical fix and not via adhering, gluing or bonding the covering elements to the backing member.

* * * * *